US007021221B2

(12) United States Patent
Del Frari

(10) Patent No.: US 7,021,221 B2
(45) Date of Patent: Apr. 4, 2006

(54) HOLDING DEVICE WITH DEMOUNTABLE PANELS AND SHELF

(76) Inventor: Paul J. Del Frari, 41 Windsong Pl., Meredith, NH (US) 03253

( * ) Notice: Subject to any disclaimer, the term of this patent is extended or adjusted under 35 U.S.C. 154(b) by 0 days.

(21) Appl. No.: 10/408,869

(22) Filed: Apr. 7, 2003

(65) Prior Publication Data

US 2004/0194674 A1 Oct. 7, 2004

(51) Int. Cl.
*A47B 23/00* (2006.01)

(52) U.S. Cl. ..... 108/42; 108/97

(58) Field of Classification Search ..... 108/42, 108/97, 28, 29, 49, 152, 90, 180, 153.1; 248/250, 248/447.2, 460; 211/86.01, 88.01, 90.01, 211/94.01, 126.01, 134, 186, 162
See application file for complete search history.

(56) References Cited

U.S. PATENT DOCUMENTS

| | | | | | |
|---|---|---|---|---|---|
| 1,075,242 | A | * | 10/1913 | Cureau | 108/152 |
| 1,295,182 | A | * | 2/1919 | Markwood | 108/152 |
| 1,588,914 | A | * | 6/1926 | Smith | 108/152 |
| 1,982,728 | A | * | 12/1934 | Ebert et al. | 108/28 |
| 3,517,625 | A | * | 6/1970 | Swett | 108/152 |
| 3,847,431 | A | * | 11/1974 | Nielsen | 108/152 |
| 4,373,639 | A | * | 2/1983 | Tricon | 108/28 |
| 4,637,632 | A | | 1/1987 | Rubash et al. | |
| 5,116,011 | A | * | 5/1992 | Smith | 108/28 |
| 5,282,427 | A | * | 2/1994 | Steinhilber | 108/97 |
| 5,325,792 | A | * | 7/1994 | Mulloy | 108/28 |
| 5,511,751 | A | | 4/1996 | Shen | |
| 5,681,022 | A | | 10/1997 | Rankin | |
| 6,182,957 | B1 | | 2/2001 | Becker | |
| 6,450,347 | B1 | | 9/2002 | Hannecke | |
| 6,637,350 | B1 | * | 10/2003 | McKsymick | 108/90 |

FOREIGN PATENT DOCUMENTS

CH 614112 A * 11/1979

* cited by examiner

*Primary Examiner*—Jose V. Chen

(57) ABSTRACT

A distribution of slip resistant under-surfacing on its frame secures this device on any flat, stable surface. Oblong bars connect perpendicularly to a corner. T-shaped grooves run the topside longitudinal axis of joined bars. T-nuts inside T-shaped grooves connect with threaded studs of hand wheels holding an oblong block in place on each bar. Each of these blocks connects with a mostly rectangular plate. An edge of each plate being opposed and parallel to the other plate's; opposed edges being covered with slip resistant material. Movement of oblong blocks towards corner moves surfaced plate edges into contact with objects positioned between plates. Plates' edging conforms to the object's contours thereby holding the object. A demountable column seats in frame's corner socket. This column has modular recesses which receive correspondingly positioned studs from a demountable bracket which functions as an adjustable shelf for other attachments.

8 Claims, 6 Drawing Sheets

Sheet
Figure 3
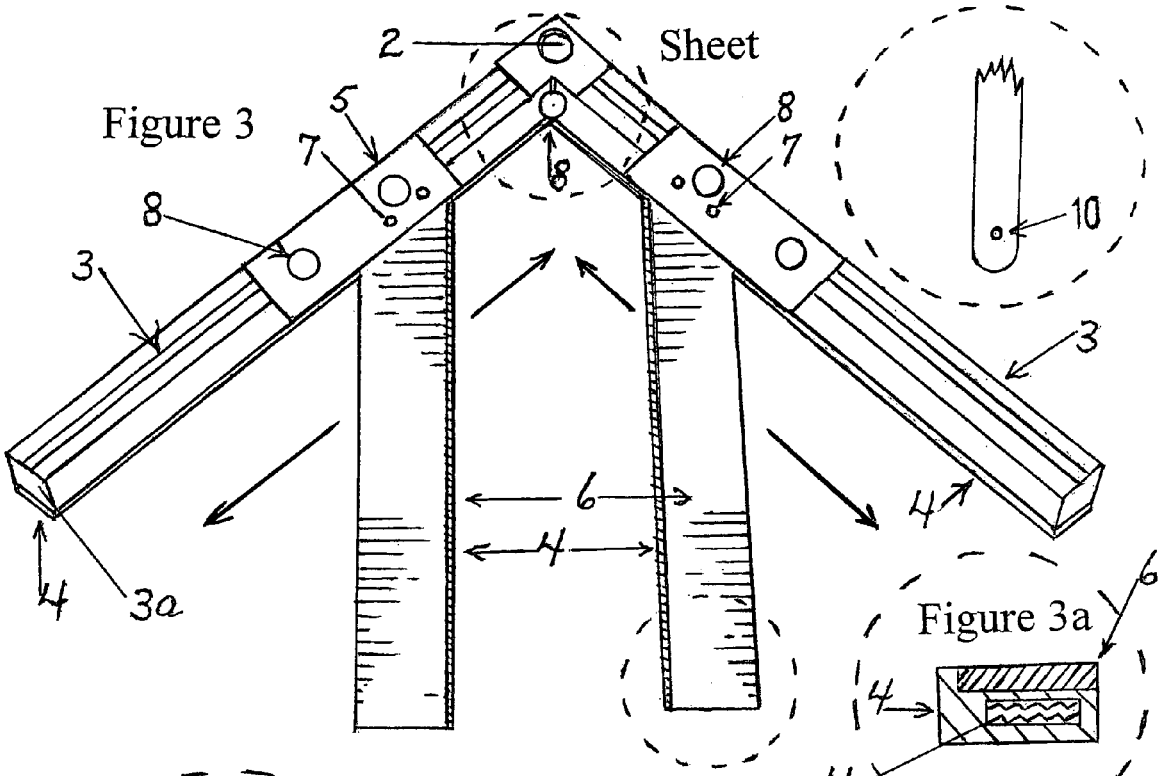
Figure 3a
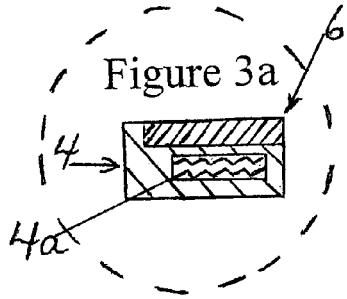
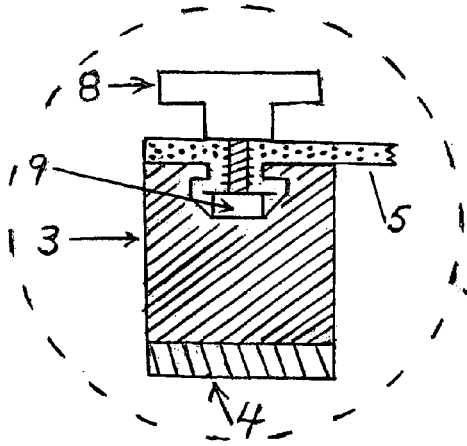
Figure 4a
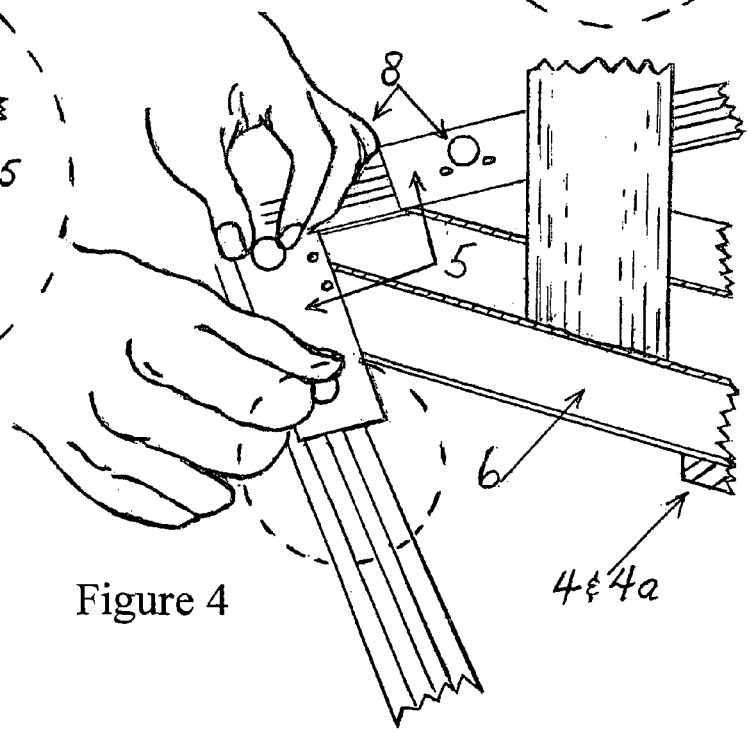
Figure 4

Figure 5
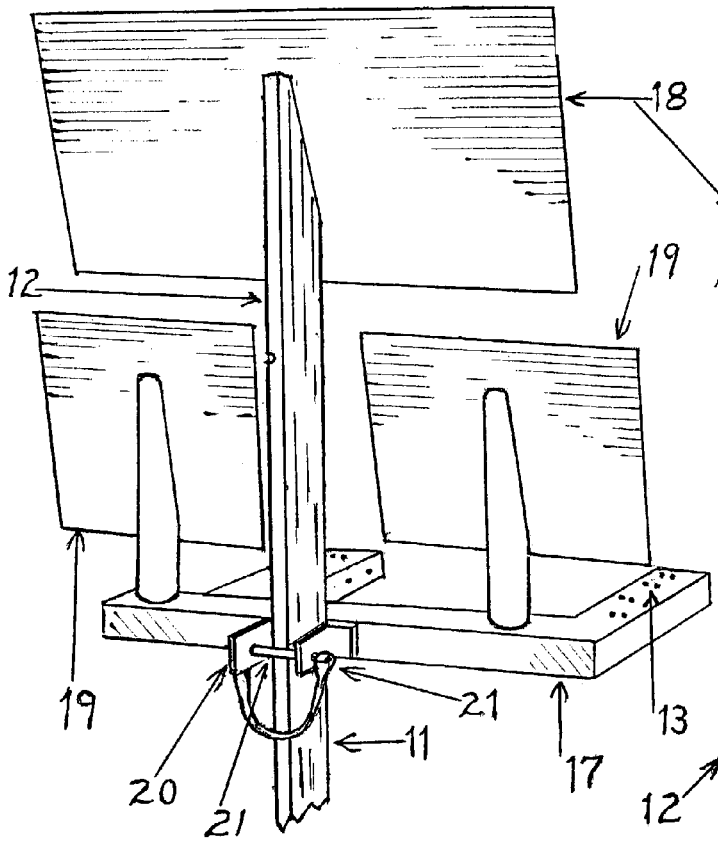
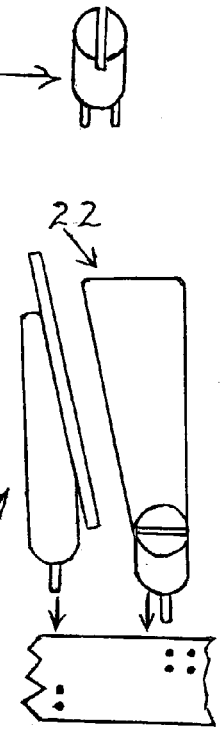
Figure 6a
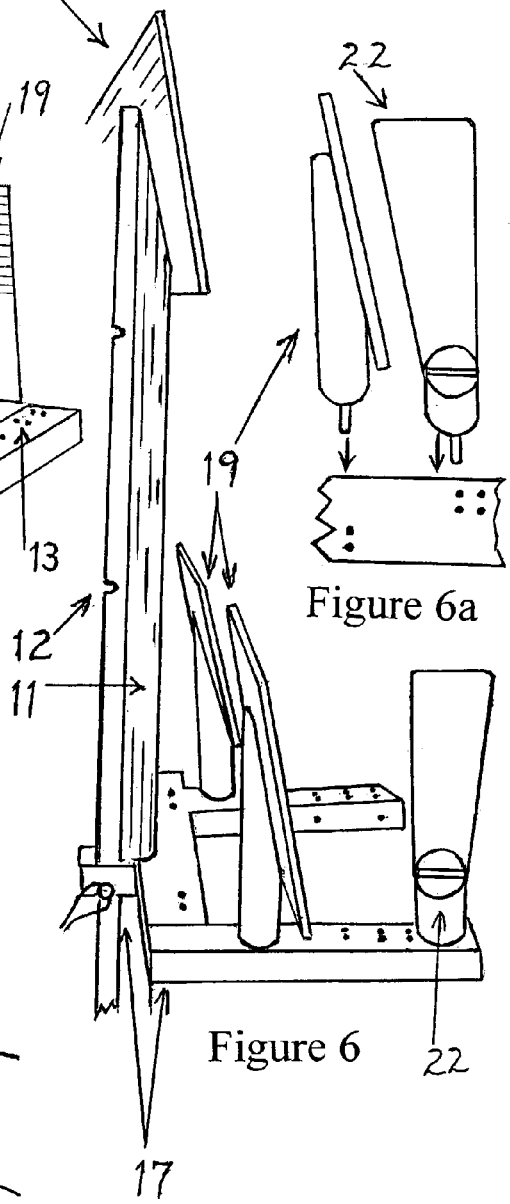
Figure 6
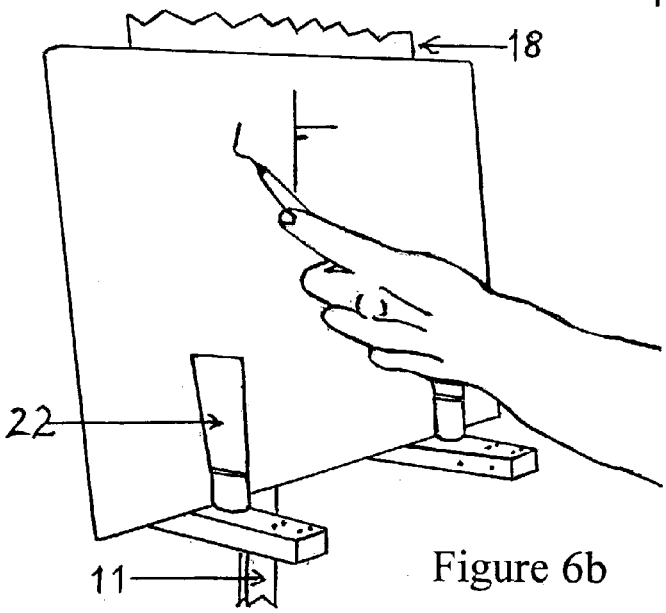
Figure 6b

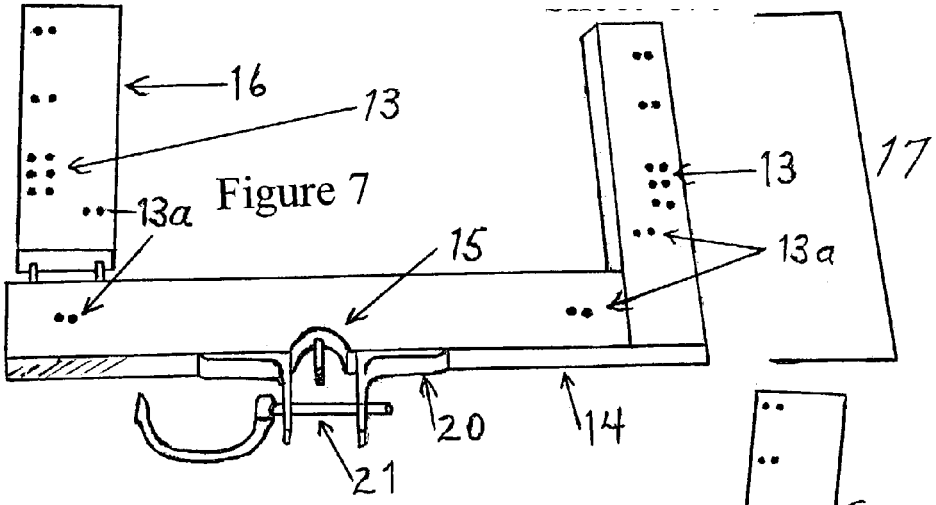
Figure 7
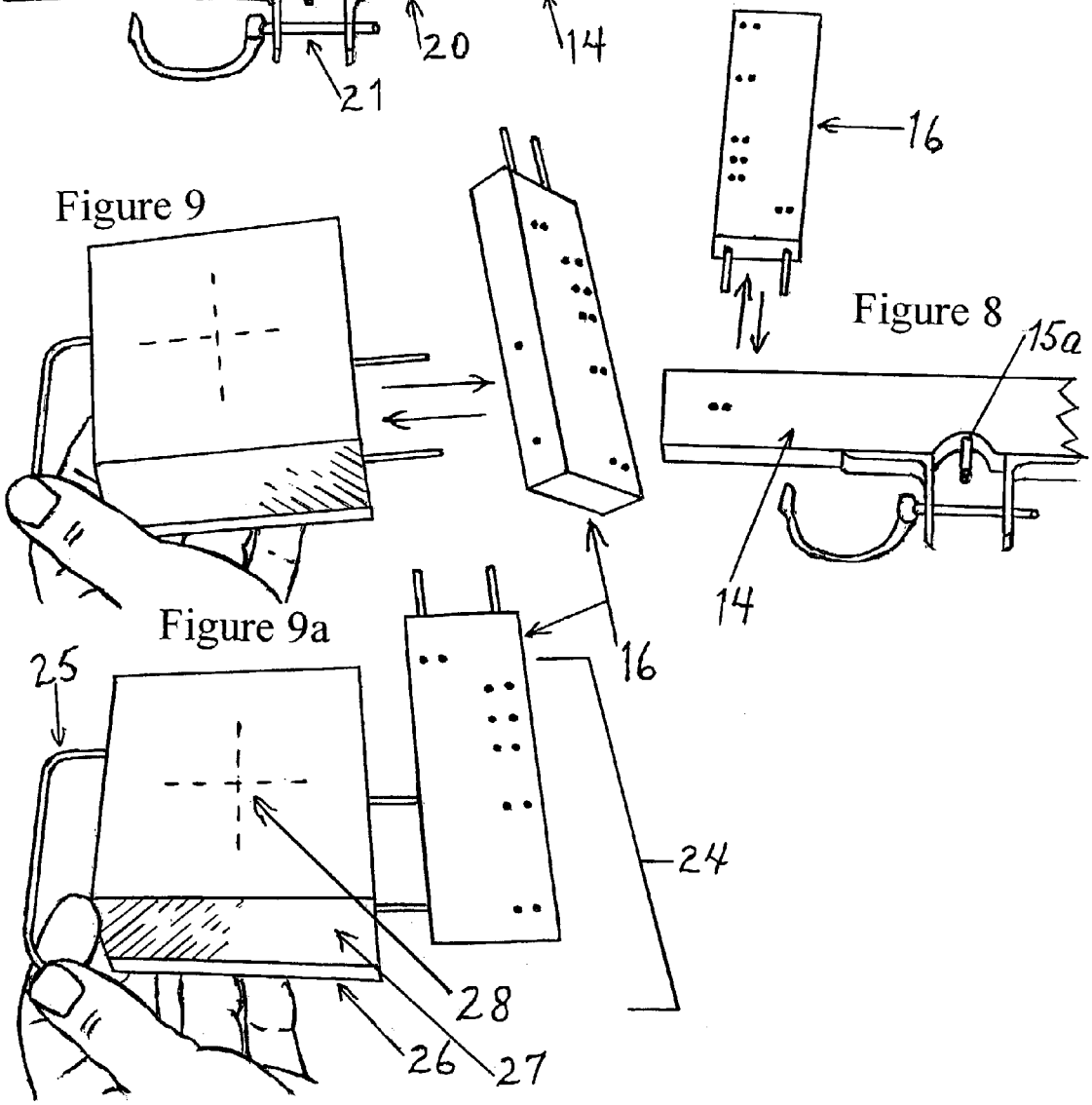
Figure 8
Figure 9
Figure 9a

HOLDING DEVICE WITH DEMOUNTABLE PANELS AND SHELF

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

This invention utilizes the demountable corner design disclosed in U.S. Pat. No. 6,302,037 to Del Frari.

The art of U.S. Pat. No. 6,302,037 addresses access and usage of conventional furniture by the disabled. This disclosure addresses assisted access to and usage of standard household, craft, and work items by improving people's ability to stabilize objects for viewing and for applying work forces to them.

Enhanced usage of commonplace items by the disabled such as a paint brush for crafts, a funnel for pouring, print directions for baking, requires consideration of a complete and unobstructed view of the task from all angles, the working distance or reach needed to do the task, bilateral strength needed, and atypical posture needs of the user dependency on a wheelchair, walker, etc.

Increased utility of holding devices comes from portability and ease of use. Efficiency and reliability of the surface bond between holding device and support surface should be immediate on all substantially flat, stable surfaces. Prior art discloses holding devices that avoid the restrictions of clamping said devices to a support by employing vacuum, magnetic, and adhesive means, or mass of the objects being held to stabilize their mount onto workplace or domestic furniture.

U.S. Pat. No. 5,681,022 to Rankin on Oct. 28, 1997 disclosed a clamping device employing a means of establishing an air pressure differential between the bottom contact surface of a holding apparatus and the top side working surface of said device. This device's variable pressure differential allows it to adhere to any relatively flat surface, a surface with curve, or a curved and irregular surface. The disadvantage to this art is the need for a source of compressed air or inert gas to modify the vacuum pressure to meet surface conditions. Compressed air is available in few homes and a hose line lead from said apparatus to said air supply would be hazardous. Additionally, said device vertically applies holding pressure covering the top an object and thereby limits the actions that can be effected on its top surface; this is restrictive to many tasks such as opening a can with a standard can opener.

U.S. Pat. No. 5,282,427 to Steinhilber on Feb. 2, 1994 discloses a device that employs multiple textile adhesive closure fasteners to secure a vertical support column of a holding device to a piece of furniture. This means of attachment requires locating a plurality of places to situate adhesive closures on the furniture to which the device is being applied so as to join the device's support column to both the floor and to a side of the article of furniture; therefore, placement of this device requires planning, access to the sides and top of the furniture, and strength to manage its proportions and apply pressure where needed. This makes multiple requirements that give weak consideration to applications that require holding for a very brief period, quick shifting of position of the holding device, or the needs of the disabled.

U.S. Pat. No. 3,847,431 to Nielsen on Nov. 11, 1974 discloses the desirability of not applying clamps, screws, or other such fasteners to an article of furniture in order to secure a holding device to it. Disclosed in his "Extensible Mounting Assembly with Means to Grip Desk" is the employment of a "resilient material" to the undersurface of members that engage the furniture's surfaces so that no damage is done when mounting and dismounting the device. While the attachment is not abusive to a furniture surface its "means to grip" the desk depends upon access to the furniture's side ledges and applying pressure from a plurality of locations by the turning of threaded knobs. As with the Steinhilber disclosure the working space required by the location of multiple places to apply pressure against the furniture's frame make it a poor remedy to the need for a quick, highly portable means of assisting holding and to the needs of the disabled.

The abstract to U.S. Pat. No. 4,637,632 to Rubash and Rubash on Jan. 20, 1987 describes "A stable, fixed relationship for a holding device is obtained through the use of two interlocking end members. The device may also be adjusted to provide the ability to hold differently sized objects." This invention overcomes the well cited prior art defect of exceedingly complicated locking relationships being necessary to readjust the lateral holding dimension to accommodate size variance of held objects. The disclosed device claims simplicity in locking in lateral dimensional change through the correspondence of insert and locking positions between the two end members. No estimate of the manual dexterity needed to execute the interlocking is provided. Its holding capability is largely limited to a preferred orientation for storage and display. Said interlocking end members inhibit access to the held object from both sides interfering with applying force to held object; also, object display is compromised by the blocking of side views by said end members. Its method of securing its position is the weight of the items captured between its opposed end members.

The bookshelf of U.S. Pat. No. 5,325,792 to Mulloy on Jul. 7, 1994 employs a pair of vertically oriented, opposed planar book supports with attached bases. "In a preferred embodiment, two identically constructed bases and book support members, each having a lock means mounted therein, are adjustably positioned" along a longitudinal guideway the bases attach to. This means of adjusting and locking the planar book supports against books overcomes the perceptual estimation skills needed by the locking means defined above in Rubash and Rubash. This device is not intended to hold objects for work to be done on them. Its planar supports occlude side views of the objects. It anticipates only one orientation of the objects being held; the upright position of books so that the identification data on their bindings can be seen and read. Its method of securing its position is the weight of the items captured between its opposed supports.

Citing the household situation that glasses, cans, bottles, and liquid vessels in general that have no structural means to stabilize themselves "are prone to being knocked down, as by bumping . . . " U.S. Pat. No. 5,511,751 to Shen on Apr. 30, 1996 discloses a structure of a stand for holding liquids safe from the unintentional effects of daily living activity. Shen's disclosure maximizes said holding stand's ability to function on any substantially flat surface by employing a suction or vacuum means of stabilizing said holding stand. Activation of the pressure differential between the bottom surface of said stand and a base surface comes from applying force to a lifting apparatus. As a general holding apparatus the most apparent defect is that the disclosed holding device is for liquids only. Additional defects are the absence of display of items being held and the challenge a lifting motion to secure a good bond presents to the disabled.

In U.S. Pat. No. 6,450,347 to Hannecke on Sep. 17, 2002 a means of holding and displaying objects ranging from thin sheets like pamphlets to merchandise boxes is disclosed. Said means derives from a modular column possessing longitudinally designated recesses receptive to positioning pegs or the like of adaptive display compartments which radially mount said column at said designated recesses. Disclosed is a system of aligning said display compartments within a display level and between successive display levels of said column. Said device is limited as a holding device in that its is purpose is the commercial display of thin and low-volume objects such as postal cards. Said device discloses clamping means for holding single sheets and the like in a rigid manner for viewing, not for applying work forces to objects.

Swiss Patent # CH 614112A to Wuerth on Nov. 11, 1979 discloses a large editing table for working on photographs and film. Disclosed is a rectangular worktable device with a surface comprised of glazed and opaque areas. A plurality of height adjustable, cantilevered arms attach to the table's frame and support multiple accessories in alignment over, or at an angles to, the glazed section of the table top. Wuerth discloses means of allowing the optical axis of a camera to be perpendicular to the glazed section of the work top. Alignment of items held in the cubic space above table top level is a challenge to the disabled. Height adjustable, cantilevered structural members with holding attachments may be used to vertically align components over a central work space; this helps to coordinate the multiple actions involved in film production techniques. No means of holding objects other than film related equipment on the table's surface are disclosed. It is hard to anticipate non-film related, domestic uses for this large device which presents access issues in terms of physical capacity of the user.

Benefit to the disabled may be anticipated from a device designed to "maximize the utilization of available space to accommodate work equipment with accessories i.e. table lighting, extension cords, keyboard support, copy holders, glare shields . . . " U.S. Pat. No. 5,116,011 to Smith on May 5, 1992 discloses such a device in an "Accessory Track Apparatus": a track for accessory items to be disposed "at a peripheral region of a top plate supporting a piece of equipment such as a personal computer." Smith discloses a means of inserting a plurality of accessory holders into said track, locking the position of these holders and the accessories they support at a position peripheral to an object on the top plate, and removing the accessories from said track. The desirable outcome of holding accessories is mitigated by the lack of a means to hold the primary object of attention, the object on the top plate. Stabilization of the plate object is assumed by its mass as with a personal computer. Total visibility is available because no consideration is given to holding and stabilizing the object; everyday objects such as those identified by Shen above—"glasses, cans, bottles, and liquid vessels in general that have no structural means to stabilize themselves are prone to being knocked down, as by bumping" or inadvertent, unintentional hand movements characteristic of many disabling conditions. The objective of holding everyday objects as needed in their routine usage is poorly addressed by this device.

U.S. Pat. No. 6,182,957 to Becker on Feb. 6, 2001 discloses an apparatus to hold flexible products of various sizes and configurations in a flat and secure position on a generally planar surface. Display of the held object is achieved by means of making said holding apparatus out of transparent material providing for visual access to all sides of the object and so that under lighting can illuminate the held item and said apparatus can function as a light table. The intent of the disclosed is for industrial purposes, to hold and retain products to be treated or processed. Said disclosure provides its own planar surface and is inherently a table designed to hold objects, not a portable holding device applicable to domestic purposes.

Prior art is improved upon by increased ease in applicability to all substantially flat, stable surfaces; prior art is improved upon by enhanced visual display of held objects; prior art is improved upon by a single device being able to hold and display sheet and bulk materials; prior art is improved upon if the device can provide for safety from accidental disturbance of unsecured objects; prior art is improved upon when the device aids alignment of components being held—laterally and vertically; prior art is improved upon when adjustments to size variation of grasped objects is made easier and more efficient; prior art is improved upon when the operation of a holding device gives consideration to the to the movement ability of its operators.

Limitations in prior art recommend a holding device which has the following characteristics: a) immediate usage upon being placed on any substantial flat and stable surface b) accessibility of object(s) being held—visually and to apply work forces c) efficient and flexible adjustments to holding means from thin sheet like materials to large bulk items d) provide for increased safety in the management of materials through means of stabilizing items from accidental forces and means for dispensing items which require caution when handling e) offer accommodation to disabled operators.

SUMMARY OF THE INVENTION

To overcome these deficiencies in prior art my invention employs a plurality of uniform size, oblong bars perpendicularly intersecting and fastening to a corner. Said corner is of prior art design. Said bars and said corner being of congruent size in a plurality of dimensions with said corner holding said bars in the same plane as itself. Each of said bars having a centered T-shaped groove running the longitudinal axis of at least one side face, opposed to said T-shape grooved side each of said bars has an un-grooved side, said un-grooved sides and said corner being uniformly covered with slip resistant material, when said slip resistant surface is positioned in contact with other objects it is a bottom to assembly of bars to corner, said bottom being of non-abrasive contact with other surfaces, said grooved sides being a top side of said corner assembly. T-nuts are slid into said top side T-shaped groove at the end opposed to said corner. An oblong block is seated on said top side of each of said bars so that its longitudinal axis corresponds to that of said bars. Each of said blocks having one or more hand wheels with threaded studs extending downwards through off-center holes in said block; said holes being aligned with the axis of said bar's T-shaped groove. Said studs extent downwards into said T-nuts in said T-shaped groove. Said blocks being wider than said bars, connection of said block to said bar cantilevers said greater width of said blocks into the space between adjacent bars. When rotated clockwise said hand wheels pull said T-nuts against the top interior side of said T-shaped groove and lock said block in place. Counterclockwise rotation releases nut pressure against said top side of said T-shaped groove and allows said block to be free to travel longitudinally in said T-shaped groove convergently and divergently from said corner.

Each of said bars connects through said blocks with a rectangular, rigid plate. The width of said plates are of lessor dimension than the longitudinal dimension of said blocks. Each of said plates attaches by fasteners at one of its ends to the underside of said cantilevered area of said blocks. Transversely cut at an acute angle said attaching plate end positions to said block so that said transversely cut side parallels and is adjacent to a side face of said bar. Attached to said block, said plate travels convergently and divergently from said corner as said block moves. Said plates are of lessor thickness than said bars and therefore are elevated above any surface said slip resistant side of said bars set upon. When said blocks are adjacent to said corner said longer sides of said plates are parallel to one another, diagonal to said corner, and abutting. The surface area of said abutting sides of said plates are covered with said slip resistant material attached to said bars. An end section of said plate underside has a thicker section of said slip resistant material bonded to it; said thicker areas allow for the embedding of objects such as weights. Said slip resistant under-surfaces of said bars and said slip resistant end sections of said plates are level with one another. Said skid resistant under-surfacing of said corner assembly immediately stabilizes on contact with a flat surface.

Said parallel and opposed edges of said plates are covered with said slip resistant material. Said convergent movement of said plates towards said corner brings said edging against contours of objects positioned between said plates. Said slip resistant material will conform to the contours of an object. One of said plate edges positioned laterally against an object stabilizes said object while said opposed plate edge is pressed against a laterally opposed side of said object, thin sheet or bulk object. Elevation of said plates by said end section under-surfacing and said attachment to said blocks allows for objects with flanged bases to be held by said slip resistant edges of said plates. In all embodiments said planar gripping motions maintain a substantial low profile, high visibility holding area.

Said corner is a cylindrical socket for a demountable column that inserts into said socket at top side surface of said corner and rises above said corner assembly. Said column has a front face and a rear area. Said front face having longitudinally aligned and intermittently spaced modular recesses. Said column connects to and is released from said corner by means of a hand wheel with threaded stud passing through a threaded aperture positioned on said corner. Said threaded aperture being aligned with said longitudinal modular recesses. Said hand wheel extends through said threaded aperture into a threaded insert in the base of said column. Said threaded insert being aligned with said modular recesses. Said rear area has a rigid longitudinal spine adhered to it at midline, said spine is correspondingly notched to said front face modular recesses. Upper section of said column supports a rigid, inclined panel.

A demountable bracket is an L-shaped assembly formed by the perpendicular joining of two rectangular blocks of equal width and equal thickness but different length. Said bracket has a plurality of modular recesses on a plurality of its sides. Said bracket has a semi-circular cut-out at midpoint of said longer rectangle of said L-shaped assembly. Said cut-out is positioned opposed to said front side of said column. The vertical midline of said cut-out has a plurality of studs extending from it. The intervals between said studs correspond with the intervals between said modular recesses of said front side of said column and said studs insert into said modular recesses thereby attaching the rear side of said bracket to said front side of said column. Said bracket attaches to said column at variable heights above said corner assembly by its removal from and insertion into said modular recesses on said longitudinal axis of said column. Laterally flanking said bracket cut-out are permanent L-shaped angles the longer arm of which is of a length great enough to extend past the diameter of said column when said bracket is inserted into it; each of said extending arms has a hole positioned in the portion of said arm extending beyond said column. When said bracket is fully inserted into said column said holes of said extending arms align with said notches of said spine. A snap pin passes through said holes and seats adjacent to said spine notch thereby forming an additional means of locking said bracket to said column.

A rectangular block has a plurality of studs at one end and modular recesses on a plurality of its sides Said studs correspond to and are inserted into modular recesses on the front side of said demountable bracket. Insertion of said rectangular block's studded end into said demountable bracket's modular recesses forms a shelf. Said studded block's insertion into varying modular recesses of said bracket varies the distance between the shorter arm of said L-shaped bracket and said demountable block. In this manner the width of said shelf is variable. Said shelf is supported by said demountable bracket's insertion into said column's modular recesses.

There are modular recesses on the top surface of all components of said shelf. Panels of smaller dimension but having the same incline as said top panel affixed to said column have a truncated columnar base with a plurality of studs extending from said base. Said truncated column's studs correspond to the spacing of said top surface modular recesses of said shelf. Said studded panels insert into and remove from said shelf by means of said studs and said recesses and therefore are demountable panels. Said demountable panels are movable between said recesses of said top side of said shelf. Said demountable panels can be advanced forward of said column or placed in lateral alignment with said column. Said forward movement being a means of advancing the angle of said fixed panel forward as the distance of said shelf from said fixed panel increases by dropping said shelf along said column.

A plurality of rigid transparent plates, each of said transparent plates being seated in a truncated columnar base with a plurality of studs extending from bottom side of said base, said studs corresponding to and inserting into said modular recesses of said top side of said shelf, said rigid transparent plate being largely rectangular with two opposed right angle corners defining a vertical length of said transparent plate and two opposed acute angles defining an inclined side opposed to said vertical side, said incline of said transparent plate corresponding to said incline of said panel forms, when said inclined side of said transparent plate is opposed to said inclined surface of said demountable panel said side and said surface are parallel to one another, when said circular base is rotated said vertical face becomes opposed to said inclined surface of said demountable panel. Said inclined side is applied in the opposed position when holding thin and sheet like materials; said straight side is applied in opposition when bulk materials are to be retained on said shelf. Large sheet material may be held when the distance between said shelf and said top panel is large.

An attachment for holding dispensing tools is comprised of a rigid square substrate base support for a top surface square of foam rubber of equal perimeter. Said substrate has a centered circular cut-out, a handle attached to one side, and a plurality of studs extending from the horizontal midline of the opposed side. Said studs insert into modular recesses located on interior sides of said shelf. Said foam rubber compresses with pressure and returns to its original contours with the removal of pressure. A transverse and longitudinal cut intersect in the center of said top square. Said cuts align with said center cut-out of said rigid substrate. Said intersection cuts are trough cuts and objects may be pushed though said intersection into said cutout and below. Said compression of said rubber against contours of an object extending into said cut-out stabilizes said object in this passageway. When the rigid substrate is inserted into said modular recesses of said shelf dispensing attachment is joined to said shelf. Said variable position of said rectangular block transfers to said substrate yielding variable alignment between said dispensing attachment and matter below said shelf.

BRIEF DESCRIPTION OF THE DRAWINGS

FIG. 3: top view of corner assembly of holding device with column insert (10)

FIG. 3*a*: end sectional view of a plate with slip resistant material (4) at edging and undersurface, and circular steel disc (4*a*) to increase surface friction by weight FIG. 4: top view of oblong blocks (5) of corner assembly with hand wheels (8)

FIG. 4*a*: cross section detail of hand wheel stud with T-nut (9) in T-shaped groove (3)

FIG. 5: rear perspective view of fixed panel (18) with demountable panels (19) in modular recesses of shelf assembly FIG. 6: side view of intermittently notched column spine (12), shelf assembly (17), demmountable panels (19), transparent plate with base (22)

FIG. 6*a*: detail view of demountable panel (19) opposed to inclined edge of transparent plate with base (22) and detail view of notched base of transparent plate (23)

FIG. 6*b*: shelf holding thin sheet material for writing, transparent plate (22) with inclined edge opposed to sheet material FIG. 7: joining of demountable bracket (14) to demountable rectangular block (16) to make shelf assembly (17) with a plurality of modular recesses (13 and 13*a*)

FIG. 8: detail of demountable rectangular block (16) corresponding to front side modular recesses of demountable bracket (14) in assembly of demountable shelf attaching to said column by corresponding contour of bracket notch (15) and bracket studs (15*a*)

FIG. 9: view of a plurality of modular recesses on a plurality of sides of demountable rectangular block (16), said block opposed to demountable dispensing attachment (24)

FIG. 9*a*: joining of dispensing attachment (24) to rectangular block (16) via insertion of studs of (24) into corresponding side modular recesses of (16)

REFERENCE NUMERALS TO DRAWINGS

Figure 1:
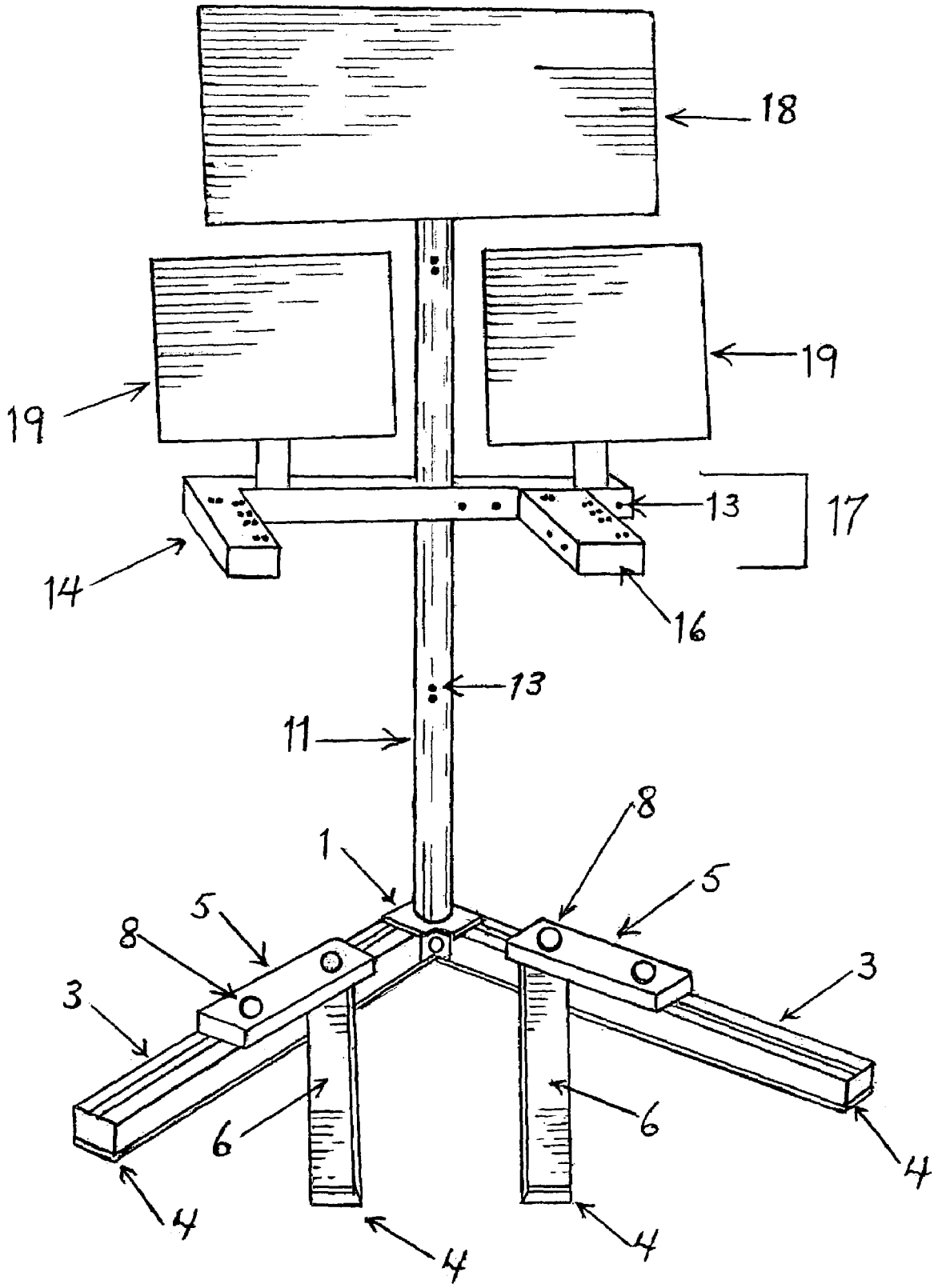
FIG. 1: front perspective view of the invention

1: corner, prior art
2: corner socket for demountable column
3: oblong bar with centered T-shaped groove running longitudinal axis
3*a*: end-cap of oblong bar, cross-sectionally closes T-shaped groove
4: slip resistant material
4*a*: circular steel disc embedded in slip resistant material
5: oblong blocks
6: plates
7: plate fasteners
8: hand wheels with threaded studs
9: T-nut seated in T-shaped groove
10: threaded insert of demountable column
11: demountable column
12: intermittently notched column spine
13: modular recesses
13*a*: modular recesses for demountable panels
14: demountable bracket
15: notch in demountable bracket
15*a*: studs at midline of bracket notch
16: demountable rectangular block with studs corresponding to side modular recesses of (14)
17: demountable shelf assembly
18: fixed position rigid panel
19: demountable rigid panels
20: fixed position bracket of (14) with aligned holes for snap pin
21: snap pin
22: transparent plate with studded base, studs correspond to top recesses of (17)
23: groove in truncated column which seats transparent plate
24: demountable dispensing attachment
25: handle of dispensing attachment
26: solid substrate square base of dispensing block with centered cut-out
27: square foam rubber top side of dispensing block
28: perpendicular intersecting through cuts of foam rubber, aligned with centered cut-out of dispensing block substrate

DETAILED DESCRIPTION OF THE INVENTION

Figure 2:
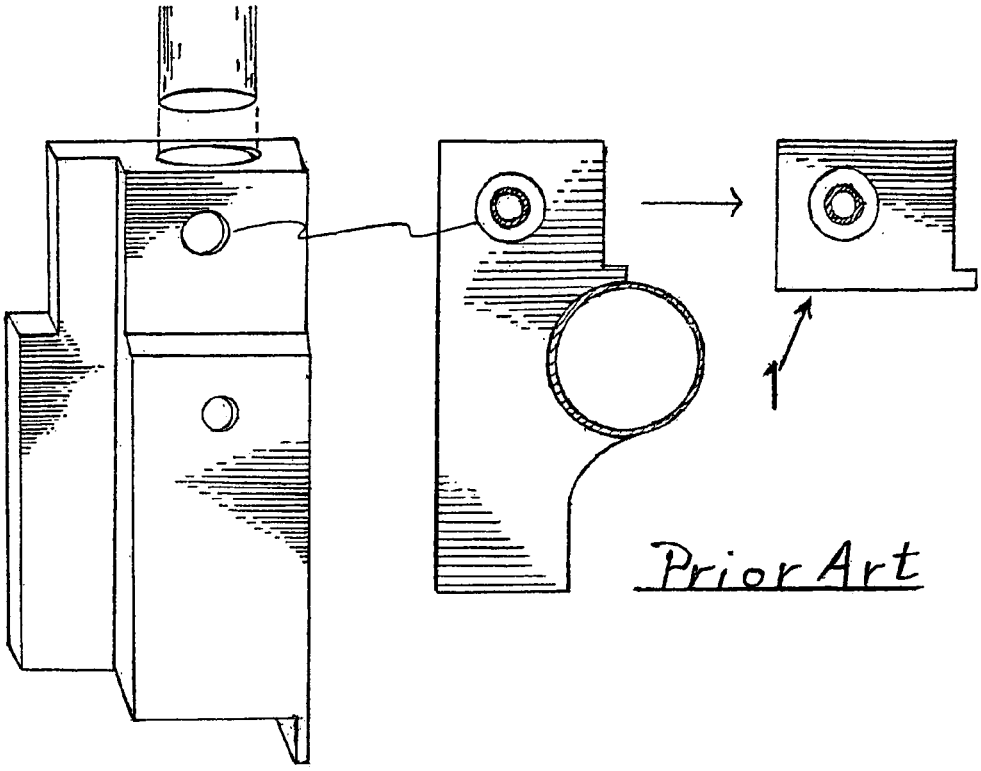
FIG. 2: side view of demountable corner of U.S. Pat. No. 6,302,037 to Del Frari
Figure 2A:
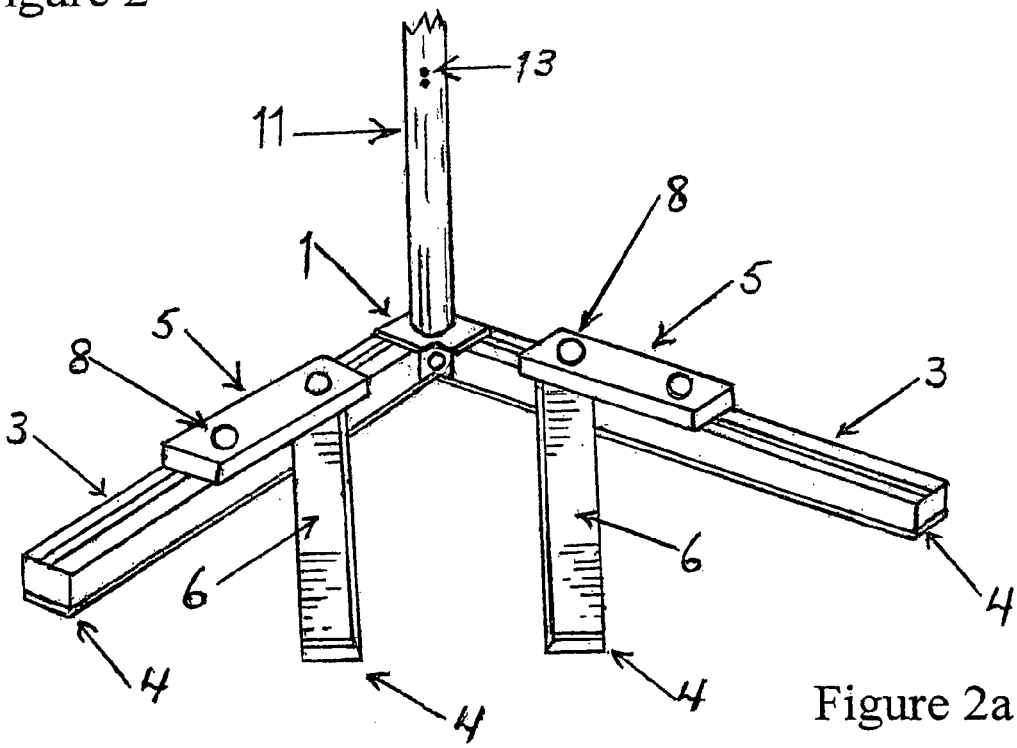
FIG. 2*a*: perspective of said demountable corner as used in holding device

A plurality of uniform size, oblong bars perpendicularly intersect and fasten to a corner (3 in FIGS. 1, 2*a*, and 3). Said corner is of prior art design (1 in FIGS. 1, 2, and 2*a*). Each of said bars having a centered T-shaped groove running the longitudinal axis of at least one side face (3 in FIGS. 1 and 3) opposed to said T-shape grooved side each of said bars has an un-grooved side, said un-grooved sides and said corner being uniformly covered with slip resistant materia (4 in FIGS. 1, 2*a*, 3, and 4*a*) when said slip resistant surface is positioned in contact with other objects it is a bottom to assembly of bars to corner, said bottom being of non-abrasive contact with other surfaces, said grooved sides being a top side of said corner assembly. T-nuts (9) are slid into said top side T-shaped groove at the end opposed to said corner (9 in FIG. 4*a*). An oblong block (5) is seated on said top side of each of said bars so that its longitudinal axis corresponds to that of said bars (5 in FIGS. 1, 2*a*, 3, and 4). Each of said blocks having one or more hand wheels with threaded studs (8) extending downwards through off-center holes (5*a*) in said block; said holes being aligned with the axis of said bar's T-shaped groove. Said studs extent downwards into said T-nuts in said T-shaped groove (FIGS. 4 and 4*a*). Said blocks being wider than said bars, connection of said block to said bar cantilevers said greater width of said blocks into the space between adjacent bars (FIG. 4*a*). When rotated clockwise said hand wheels pull said T-nuts against the top interior side of said T-shaped groove and lock said block in place. Counterclockwise rotation releases nut pressure against said top side of said T-shaped groove and allows said block to be free to travel longitudinally in said T-shaped groove convergently and divergently from said corner.

Each of said bars connects by means of said blocks with one or more mostly rectangular plates (6 in FIGS. 3 and 4). Each of said plates attaches by fasteners at one its ends to the underside of said cantilevered area of said blocks (7 in FIGS. 3 and 5 in FIG. 4). Transversely cut at an acute angle, an end of said attaching plate positions to said block. Attached, said transversely cut end parallels and is adjacent to a side face of said bar. Attached to said block, said plate travels convergently and divergently from said corner as said block moves (FIG. 3). When said blocks are adjacent to said corner said longer sides of said plates are parallel to one another, diagonal to said corner, and abutting (FIG. 3). An end section of said plate underside has a thicker and weighted section of said slip resistant material bonded to it; said thicker areas allow for the embedding of objects such as weights (4*a* in FIGS. 3*a* and 4). Said variance of thickness of said slip resistant material aligns said plane of said slip resistant under-surfaces of said bars and said plates; said alignment being correspondingly parallel to a level surface.

Opposed edges of said plates are covered with said slip resistant material (4 in FIGS. 3 and 3*a*). Said convergent movement of said plates towards said corner brings said edging against the contours of objects positioned between said plates. Said slip resistant material will conform to the contours of an object. One of said plate edges positions laterally against an object to stabilize said object while said opposed plate edge is pressed firmly against a lateral side of said object, (FIG. 4). Said plate under-surfacing with said slip resistant material and said attachment of said plates to said blocks elevates the main body of said plates. Said elevation allows for objects with flanged bases to be held by said edges of said plates. Said plates can vary dimensionally but in all embodiments said planar gripping motions maintain a substantial low profile, high visibility holding area.

Said corner is a cylindrical socket for a demountable column (11 in FIGS. 1, 5, and 6) that secures into said socket at top side surface of said corner (2 in FIG. 3). Said column rises above said corner assembly. Said column has a front face and a rear area. Said front face has longitudinally aligned and intermittently spaced modular recesses (13 in FIGS. 1 and 10). Said rear area has a rigid longitudinal spine (12 in FIGS. 5 and 6) correspondingly notched to said front face modular recesses. Said front face of said column has a threaded insert in its lowermost section (10 in detail of FIG. 3). Said insert aligns with a threaded aperture of said corner connecting perpendicularly to said socket. One of said hand wheels with threaded stud passes through said aperture into said insert (8 in FIG. 3). Clockwise rotation of said hand wheel applies pressure to the base of said column holding it securely in place. Counterclockwise rotation of said hand wheel withdraws said threaded stud from said insert and releases said column to be lifted out of said socket. A sill at the base of said socket stops the descent of said column in said socket. Upper section of said column supports a rigid, inclined panel (18 in FIGS. 1, 5, 6, and 6*b*).

A demountable bracket (14 in FIGS. 7 and 8) is an L-shaped assembly formed by the perpendicular joining of two rectangular blocks of equal width and equal thickness but different length. Said bracket has a plurality of modular recesses on a plurality of its sides. Said bracket has a semi-circular cut-out at midpoint of said longer rectangle of said L-shaped assembly (15 in FIG. 7). Said cut-out is positioned opposed to said front side of said column. The vertical midline of said cut-out has a plurality of studs extending from it (15*a* in FIG. 8). The intervals between said studs correspond with the intervals between said modular recesses of said front side of said column and said studs insert into said modular recesses thereby attaching the rear side of said bracket to said front side of said column (17 in FIG. 6). Said bracket attaches to said column at variable heights above said corner assembly by its removal from and insertion into said modular recesses on said longitudinal axis of said column (FIGS. 5 and 6).

A rectangular block has a plurality of studs at one end (16 in FIG. 8). Said studs correspond to and are inserted into modular recesses on the front side of said demountable bracket (14 in FIG. 8). Assembly by insertion of said rectangular block studs into said demountable bracket recesses forms a shelf. Said shelf being comprised of said demountable bracket and placement of said block (16) in a parallel and opposed position to the shorter section of said bracket. Said shelf is supported by said demountable bracket's insertion into said column's modular recesses (17 in FIGS. 5 and 6). Additional support of said shelf is achieved by insertion of a snap pin (21 in FIGS. 5 and 7) through one of said column's rear notches (12) and aligned holes in a pair of brackets (20) that flank said rear side notch of said demountable bracket. Said shelf positions intermittently at said column's front recesses (13 in FIG. 1).

Figure 10:
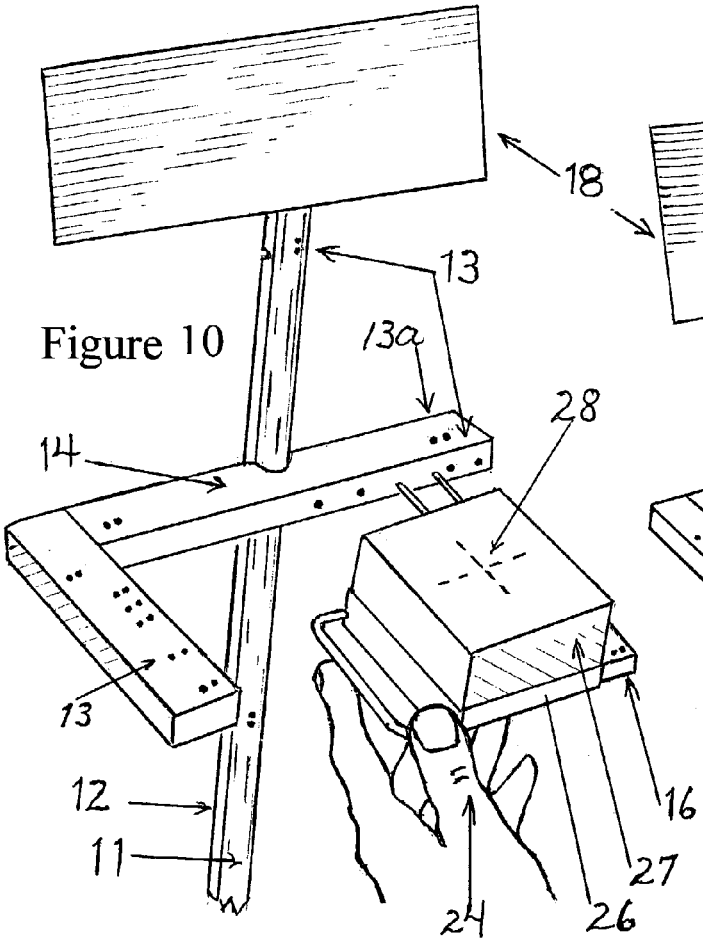
FIG. 10: dispensing attachment (24) joining demountable bracket (14) by insertion of block studs of (16) into front side modular recesses of (14)

FIGS. 7 and 10 show stud insertion into a plurality of modular recesses (13) on front side of said demountable bracket (14) yielding variable lateral positioning of said demountable block (16) and demountable dispensing attachments (24) to said block (FIGS, 9, 9*a*, 10, 10 *a*).

There are modular recesses on the top surface of all components of said shelf assembly (13*a* in FIG. 7). Panels of smaller dimension but having the same incline as said top panel (19 in FIGS. 6 and 6*a*) have a truncated columnar base with a plurality of studs extending from said base (19 in FIG. 6*a*). Said truncated column's studs correspond to the spacing of said top surface modular recesses of said shelf. Said studded panels insert into and remove from said shelf by means of said studs and said modular recesses and therefore are demountable panels (19 in FIG. 6*a*). Said demountable panels are movable between said recesses of said top side of said shelf. Said demountable panels can be advanced forward of said column or placed in lateral alignment with said column (FIGS. 5 and 6). Said forward movement being a means of advancing the angle of said fixed panel forward as the distance of said shelf from said fixed panel increases by dropping said shelf along said column.

A plurality of rigid transparent plates, each of said transparent plates being seated in a truncated columnar base with a plurality of studs extending from bottom side of said base (22 in FIG. 6*a*), said studs corresponding to and inserting into said modular recesses of said top side of said shelf, said rigid transparent plate being largely rectangular with two opposed right angle corners defining a vertical length of said transparent plate and two opposed acute angles defining an inclined side opposed to said vertical side, said incline of said transparent plate corresponding to said incline of said panel forms, when said inclined side of said transparent plate is opposed to said inclined surface of said demountable panel they are parallel to one another (FIG. 6*a*), when said circular columnar base is rotated 180 degrees said vertical face becomes opposed to said inclined surface of said demountable panel (FIG. 6), said inclined side of said transparent plate is applied towards sheet materials (22 in FIG. 6*b*), said vertical side of said transparent plate is applied towards bulk objects. Large sheet material may be held when the distance between said shelf and said top panel is large.

Figure 10A:
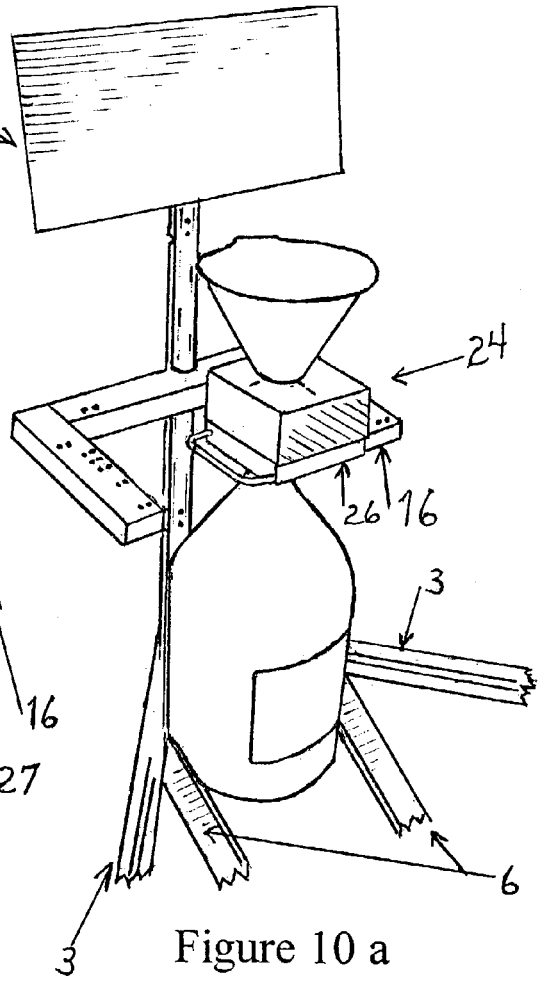
FIG. 10*a*: dispensing attachment (24) with funnel passing through perpendicular through cuts (28) in square foam rubber top (27) and descending through passageway into cut-out center of rigid substrate square (26) of said attachment
Figure 10B:
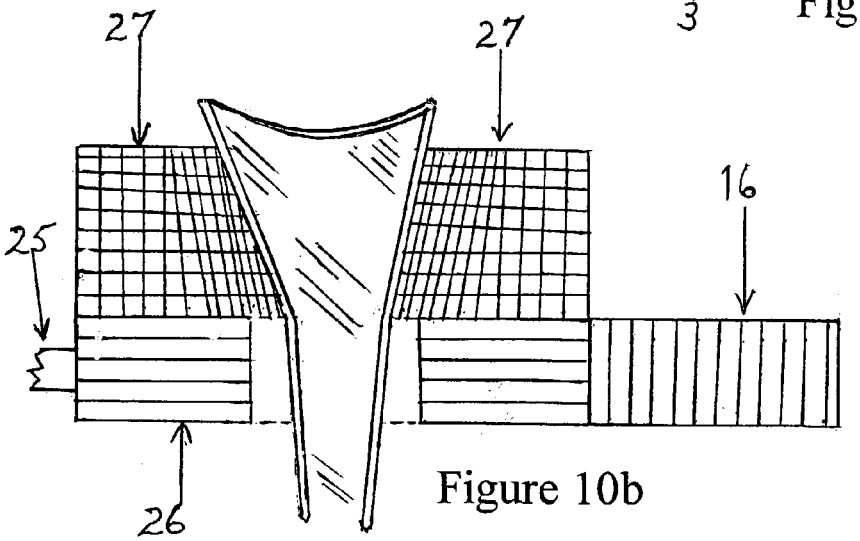
FIG. 10*b*: cross section view of dispensing attachment (24) with funnel in passageway

A rigid square substrate (26 in FIG. 9*a*) is the base support for a top surface square of foam rubber of equal perimeter (27 in FIG. 9*a*). Said substrate has a centered circular cut-out (26 in FIG. 10*b*). Said substrate has a handle attached to one side and a plurality of studs at the opposed side (FIGS. 9 and 9*a*). Said studs insert into said modular recesses of side face of said rectangular block (16). Said form rubber compresses with pressure and returns to original contours with the removal of pressure (FIG. 10*b*). A transverse cut and a longitudinal cut intersect in the center of said top square (27 in FIG. 9*a*), said cuts align with said center cut-out of said rigid substrate. Said intersection cuts are trough cuts and objects may be pushed though said intersection into said cut-out and below. Compression of said rubber against an object extending into said cut-out stabilizes said object in this passageway (27 in FIG. 10*b*). When said rigid substrate is inserted into said rectangular block (26 and 16 in FIG. 10*b*) said squares may be attached to said shelf (FIGS. 10 and 10*a*). Said variable position of said rectangular block transfers to said substrate yielding variable alignment with matter below said shelf.

I claim:

1. A holding device comprising:

a corner bracket having first, second, and third openings;

a first elongate base member having a proximal end secured within said first bracket opening and a distal end opposite the proximal end;

a second elongate base member having a proximal end secured within said second bracket opening and a distal end opposite the proximal end, said first and second elongate base members extending perpendicular to one another;

each of said first and second elongate base members having an upper surface and a lower surface opposite the upper surface, said lower surface adapted to engage a support surface;

a first sliding member slidingly engaging the upper surface of said first base member and slidable along its length;

a second sliding member slidingly engaging the upper surface of said second base member and slidable along its length;

a first fastener engaging said first sliding member and said first base member, said first fastener manually operable to selectively secure said first sliding member and said first base member in fixed relative position and alternately to release said first sliding member and said first base member to permit sliding movement of said first sliding member relative to said first base member;

a second fastener engaging said second sliding member and said second base member, said second fastener manually operable to selectively secure said second sliding member and said second base member in fixed relative position and alternately to release said second sliding member and said second base member to permit sliding movement of said second sliding member relative to said second base member;

each of said first and second base members having a slip-resistant material disposed on the lower surface thereof;

a first arm attached to the first sliding member and elevated above the support surface, said first arm having a first peripheral edge surface which is parallel to an aligned facing surface of said first base member and a second, gripping peripheral edge surface having a slip-resistant material thereon; and a second arm attached to the second sliding member, said second arm elevated above the support surface and extending parallel to the first arm, said second arm having a first peripheral edge surface which is parallel to an aligned facing surface of said second base member and a second, gripping peripheral edge surface having a slip-resistant material thereon, said second arm second gripping surface in parallel and facing relation to said first arm gripping surface, wherein sliding movement of one or both of said first and second sliding members causes parallel relative movement between said first and second arms.

2. The holding device of claim 1, further comprising:

a vertically extending column having a first end and a second end opposite the first end, said first end received within said third opening of said corner bracket;

an inclined rigid panel attached to said column second end; and a fastener for releasably securing said column to said corner bracket.

3. The holding device of claim 2, further comprising:

a plurality of axially-spaced apart modular recesses formed on a first side of said column;

a demountable bracket for attaching laterally to said column at a plurality of axial positions thereon, said demountable bracket having a notch formed in a first side thereof adapted to partially receive said column; and a fastener for securing the demountable bracket to said column at a desired axial position via said plurality of axially-spaced apart modular recesses formed on said column first side, said fastener including at least one protrusion extending from said notch formed on said demountable bracket for engaging a selected one of said axially-spaced apart modular recesses.

4. The holding device of claim 3, further comprising:

said demountable bracket having a plurality of modular recesses formed thereon;

said demountable bracket further including a demountable block having a plurality of studs at an end thereof for attachment at a desired position thereon via said plurality of modular recesses on said demountable bracket; and said demountable block having a plurality of modular recesses on a plurality of sides of said demountable block.

5. The holding device of claim 4, further comprising:

said demountable bracket further including a nonmovable shelf element extending from a second side of the demountable bracket opposite the first side;

said demountable block attachable to the demountable bracket to define a movable shelf element; and a plurality of modular recesses spaced along on said second side of said demountable bracket, wherein attachment of said studs of said demountable block to different ones of said plurality of modular recesses on said demountable bracket second side corresponds to varying distances between said movable and nonmovable shelf elements.

6. The holding device of claim 3, further comprising:

said demountable bracket having a plurality of modular recesses formed thereon;

one or more demountable panel members attached to said demountable bracket;

each of said one or more demountable panel members including a truncated column having an inclined panel at a first end thereof, and a plurality of studs at a second end of the truncated column opposite the first end; and said plurality of studs mating with corresponding ones of said plurality of modular recesses formed on said demountable bracket such that each of said one or more demountable inclined panels are coplanar with said rigid inclined panel.

7. The holding device of claim 3, further comprising:

said demountable bracket having a plurality of modular recesses formed thereon;

a demountable holder for sheet and bulk materials, said demountable holder including a rigid transparent plate seated in a base, said base having a plurality of studs extending from a surface of said base opposite the transparent plate, said studs mating with said modular recesses formed on said demountable bracket, said rigid transparent plate having a first, vertically extending peripheral edge, and a second, inclined peripheral edge opposite said vertical peripheral edge; and said inclined peripheral edge having an incline parallel to said inclined panel when the base is mounted on said demountable bracket and said inclined side of said transparent plate is facing toward said inclined surface of said demountable panel.

8. The holding device of claim 3, further comprising:

said demountable bracket having a plurality of modular recesses formed thereon;

a dispensing attachment having a substrate attachable to said demountable bracket at various positions via said plurality of modular recesses on the demountable bracket, said substrate having a central opening therethrough; and said dispensing attachment further including a layer of compressible foam rubber on said substrate and having intersecting slits defining an opening in said foam layer aligned with said opening in said substrate, the aligned openings allowing passage of a dispensing tool therethrough and said compressible foam rubber resiliently deformable to exert a holding pressure against the dispensing tool.

* * * * *